US009130283B1

(12) United States Patent
Lin

(10) Patent No.: US 9,130,283 B1
(45) Date of Patent: Sep. 8, 2015

(54) ELECTRICAL CONNECTOR WITH MULTI-DIRECTION CABLE INSTALLATION CAPABILITY

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 47 days.

(21) Appl. No.: 14/183,454

(22) Filed: Feb. 18, 2014

(51) Int. Cl.

| | |
|---|---|
| ***H01R 13/506*** | (2006.01) |
| ***H01R 4/24*** | (2006.01) |
| ***H01R 13/629*** | (2006.01) |
| ***H01R 13/502*** | (2006.01) |

(52) U.S. Cl.
CPC ..... *H01R 4/242* (2013.01); *H01R 13/502* (2013.01); *H01R 13/629* (2013.01)

(58) Field of Classification Search
CPC ..... H01R 13/506; H01R 13/595; H01R 13/5829; H01R 13/501; H01R 13/516
See application file for complete search history.

(56) References Cited

U.S. PATENT DOCUMENTS

| | | | | |
|---|---|---|---|---|
| 4,501,459 | A * | 2/1985 | Chandler et al. | 439/295 |
| 5,934,931 | A * | 8/1999 | Castaldo | 439/467 |
| 7,413,464 | B1 * | 8/2008 | Chen | 439/404 |
| 7,537,478 | B2 * | 5/2009 | Foltz et al. | 439/468 |
| 7,713,081 | B2 * | 5/2010 | Chen | 439/468 |
| 7,967,642 | B2 | 6/2011 | Schoene et al. | |
| 8,376,779 | B2 | 2/2013 | Metral et al. | |
| 8,834,196 | B2 * | 9/2014 | Duran et al. | 439/459 |
| 2003/0022549 | A1 * | 1/2003 | Castaldo et al. | 439/467 |
| 2004/0038582 | A1 * | 2/2004 | Clement | 439/467 |
| 2010/0233900 | A1 * | 9/2010 | Gimbel | 439/467 |

* cited by examiner

*Primary Examiner* — Gary Paumen
(74) *Attorney, Agent, or Firm* — Guice Patents PLLC

(57) ABSTRACT

An electrical connector with multi-direction cable installation capability includes a connector body, upper and lower cable protector covers pivotally connected to a rear side of the connector body and defining multiple cable insertion openings in different directions, a cable organizer lockable to the connector body by the upper and lower cable protector covers to keep core wires of an inserted cable in position, and an end cap detachably attached to the cable organizer and defining an opening for selectively matching with one of the cable insertion opening to provide a cable passage through which the inserted cable extends out of the electrical connector.

10 Claims, 12 Drawing Sheets

ELECTRICAL CONNECTOR WITH MULTI-DIRECTION CABLE INSTALLATION CAPABILITY

BACKGROUND OF THE INVENTION

1. Field of the Invention

The present invention relates to electrical connector technology and more particularly, to such an electrical connector that allows installation of a cable in the top, bottom, left, right or rear side thereof selectively.

2. Description of the Related Art

Conventional network connectors (such as keystone jack) generally have the cable outlet horizontally arranged at the rear side. When a network connector of this design is mounted at a panel and electrically connected to an internal circuit in an electrical box at the panel, the length of the network connector may occupy the whole area between the panel and the bottom side of the electrical box.

If the cable must be inserted into the electrical box from the left or right side, the user needs to curve the cable through 90° angle and then electrically connect the cable to the electrical connector. However, when the cable is curved through 90° angle, it has zero radius of curvature. Based on the transmission-line theory for electromagnetic waves, reducing the radius of curvature of the conductor will relatively lower the rate of electromagnetic transmission, and will likely cause scattering of electromagnetic waves. A network cable generally comprises 8 pcs of core wires arranged in four twisted pairs. If a network cable is curved through 90° angle, every core wire of the network cable can cause scattering of electromagnetic waves, increasing the risk of magnetic interference between the core wires and deterioration of the transmission characteristics of the network cable.

To prevent the aforesaid problems, network connectors with lateral cable outlet design are created, preventing curving of the installed cable.

However, these network connectors also have their also disadvantages while providing benefits. For example, if two network connectors with same direction of lateral cable outlet are arranged in parallel, one network connector will interfere with the lateral cable outlet of the other network connector; if two network connectors having reversed lateral cable outlets are arranged in a line, one of two cables that are arranged at one lateral side relative to the two network connectors can be directly inserted through the lateral cable outlet of one network connector and electrically connected to the respective network connector, however, the other cable must be curved through 180° angle and then inserted into the lateral cable outlet of the other network connector.

Further, the aforesaid prior art network connectors for lateral cable installation are designed for installation in a panel and an electrical box, not suitable for computer or machine room application. Therefore, the aforesaid prior art network connectors have a limited range of applications.

3M company's U.S. Pat. No. 7,967,642 discloses a network connector, entitled "Connector in the field of telecommunications". According to this design, the connector in the field of telecommunications comprises: a housing having a rectangular opening on one side unto which a complementary connector can be inserted, a plurality of contacts with which wires are connectable inside the connector, and a guide piece connected to the connector opposite the side where the complementary connector is inserted, the guide piece having three wire openings disposed on an outside surface of the guide piece and exposed on an outside of the connector distal from the contacts, wherein the wire openings are oriented in different directions wherein the housing is provided with at least one pivoted drive piece adapted to drive the guide piece towards the contacts. Further, the at least three wire openings are oriented in different radial directions from a center region of the connector. Further, the drive piece is a pivotable flap having at least one projection adapted to drive the guide piece when the flap is pivoted.

3M company's U.S. Pat. No. 8,376,779 discloses another design of network connector in the field of telecommunications that comprises: a housing, a plurality of contacts disposed within the housing and with which wires are connectable inside the connector, a guide piece having a plurality of wire openings disposed on the rear side of the housing, and a connector shielding attached to a rear side of a connector having an entry portion aligned with one of the wire openings in the guide piece and an extension mounted over said entry portion that is connectable with a cable shielding of a cable. Further, the connector has at least three wire openings. Further, each wire opening is adapted to accommodate at least two wires and exposed on an outside of the connector distal from the contacts. Further, the wire openings are exposed in at least three different directions.

U.S. Pat. No. 7,967,642 discloses three wire openings located at the rear side of the connector at different elevations and oriented in different directions.

Further, U.S. Pat. No. 8,376,779 discloses at least three wire openings, and a connector shielding providing an electromagnetic wave shielding effect.

The aforesaid US patents improve the drawbacks of conventional network connectors and prevent curving of the installed cable. However, the network connectors in the field of telecommunications of the aforesaid 3M's US patents simply provide three wire openings oriented in three directions (upper, middle, and lower), not suitable for use with an electrical box that simply allows installation of the cable from the left or right side. Therefore, an improvement in this regard is desired.

SUMMARY OF THE INVENTION

The present invention has been accomplished under the circumstances in view. It is therefore the main object of the present invention to provide an electrical connector, which effectively prevents deterioration of the transmission characteristics of the installed cable.

It is another object of the present invention to provide an electrical connector, which allows installation of a cable in different directions to widen the range of applications.

To achieve these and other objects of the present invention, the present invention provides an electrical connector that comprises a connector body, an upper cable protector cover and a lower cable protector cover, a cable organizer, and an end cap. The connector body comprises opposing front and rear sides, a plug hole defined in the front side thereof for receiving an external mating electrical connector, a plurality of insulation displacement contacts mounted in the rear side thereof, two extension plates inwardly retracted and respectively backwardly extended from two opposite lateral sides thereof and two pressure bars respectively backwardly extended from the extension plates. Further, each pressure bar comprises a plug rib located at an inner side thereof, and an end flange located at a distal end thereof. The upper cable protector cover and the lower cable protector cover are respectively pivotally connected to the connector body, and biasable relative to the connector body between an open position and a close position. The upper cable protector cover and the lower cable protector cover define a cable insertion opening in each of top, bottom, left and right sides thereof around the rear side of the connector body when they are in the close position. The cable organizer is mounted at the rear side of the connector body, comprising a center hole for the insertion of a cable, a plurality of wire grooves located at a front side thereof and facing toward the connector body for securing core wires of an inserted cable, a protruding seat located at a rear side thereof, a plurality of cable grooves formed in the protruding seat at top, bottom, left and right sides, two side notches respectively located at two opposite lateral sides thereof to fit the pressure bars, and two guide slots respectively disposed in the side notches corresponding to the plug ribs of the pressure bars. The end cap is detachably fastenable to the upper cable protector cover and the lower cable protector cover, comprising at least one opening selectively forming with one of the cable insertion openings defined by the upper cable protector cover and the lower cable protector cover a cable passage for the passing of a cable that is electrically connected to the insulation displacement contacts.

Preferably, the connector body comprises a plurality of pivot holes respectively disposed in corners around the rear side thereof; the upper cable protector cover and the lower cable protector cover each comprise two pivot pins bilaterally disposed at a front side thereof and respectively pivotally coupled to the pivot holes of the connector body.

Preferably the upper cable protector cover and the lower cable protector cover each comprise a plurality of retaining holes; the end cap comprises two diagonal pairs of hooks respectively disposed in four corners at a rear side thereof and selectively engaged into the retaining holes of the upper cable protector cover and the lower cable protector cover.

Preferably, one diagonal pair of hooks of the end cap extends in vertical, and the other diagonal pair of hooks of the end cap extends in horizontal.

Preferably, the connector body further comprises two locating blocks bilaterally disposed near the rear side thereof for securing the upper cable protector cover and the lower cable protector cover in place. Each locating block comprises two bevel guide edges symmetrically disposed at opposing top and bottom sides thereof. The upper cable protector cover and the lower cable protector cover each comprise two notches respectively disposed corresponding to the bevel guide edges of the two locating blocks.

Preferably, the end cap further comprises a plurality of retaining blocks bilaterally disposed at a front side thereof; the upper cable protector cover and the lower cable protector cover each comprise a plurality of bottom retaining grooves respectively forced into engagement with the retaining blocks of the end cap.

Preferably, the end cap further comprises a back opening serving as a cable passage, and a movable back cover plate adapted for closing the back opening.

Preferably, the end cap further two pivot holes respectively disposed at two opposite lateral sides thereof above the back opening; the movable back cover plate comprises a pivot pin transversely disposed near a top side thereof and pivotally coupled to the pivot holes of the end cap and biasable relative to the end cap to close or open the back opening.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
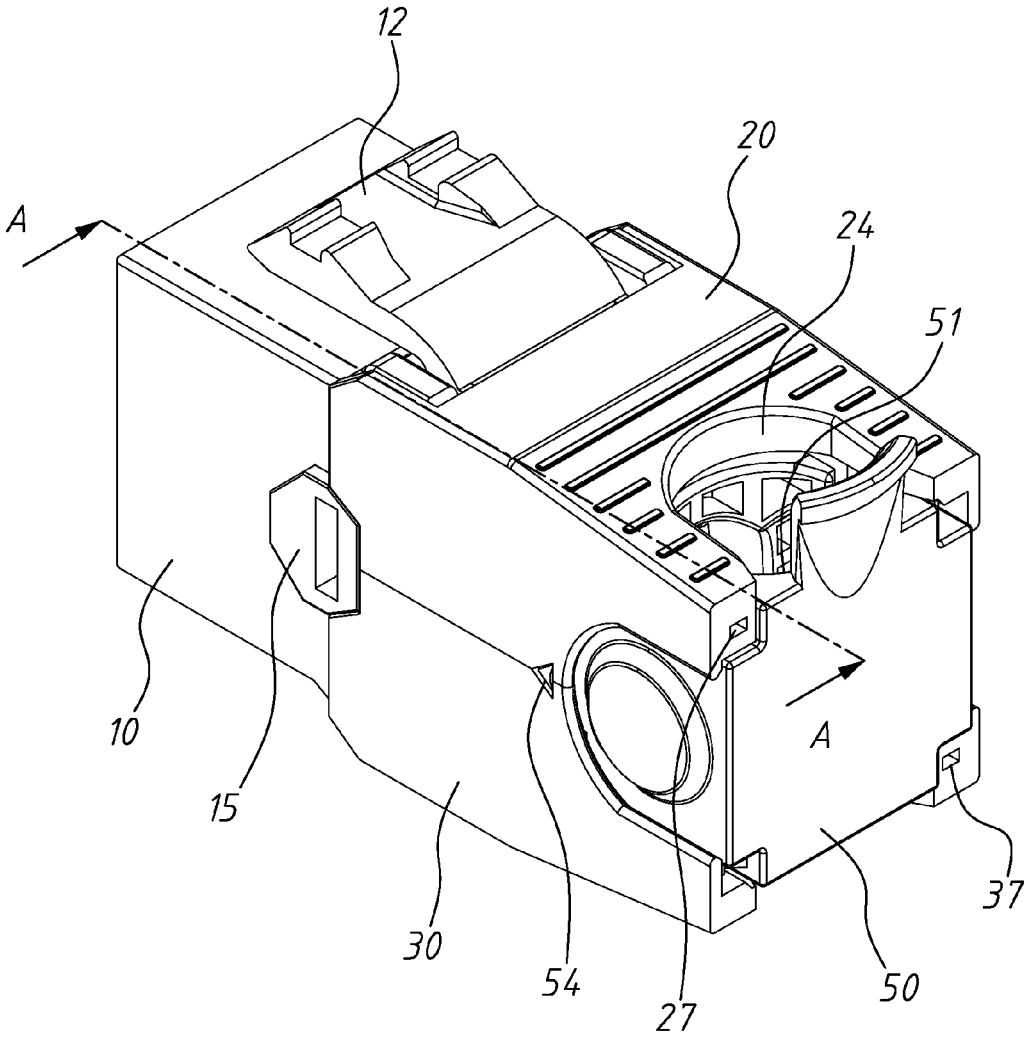
FIG. 1 is an oblique top elevational view of an electrical connector in accordance with the present invention.
Figures 2, 2A:
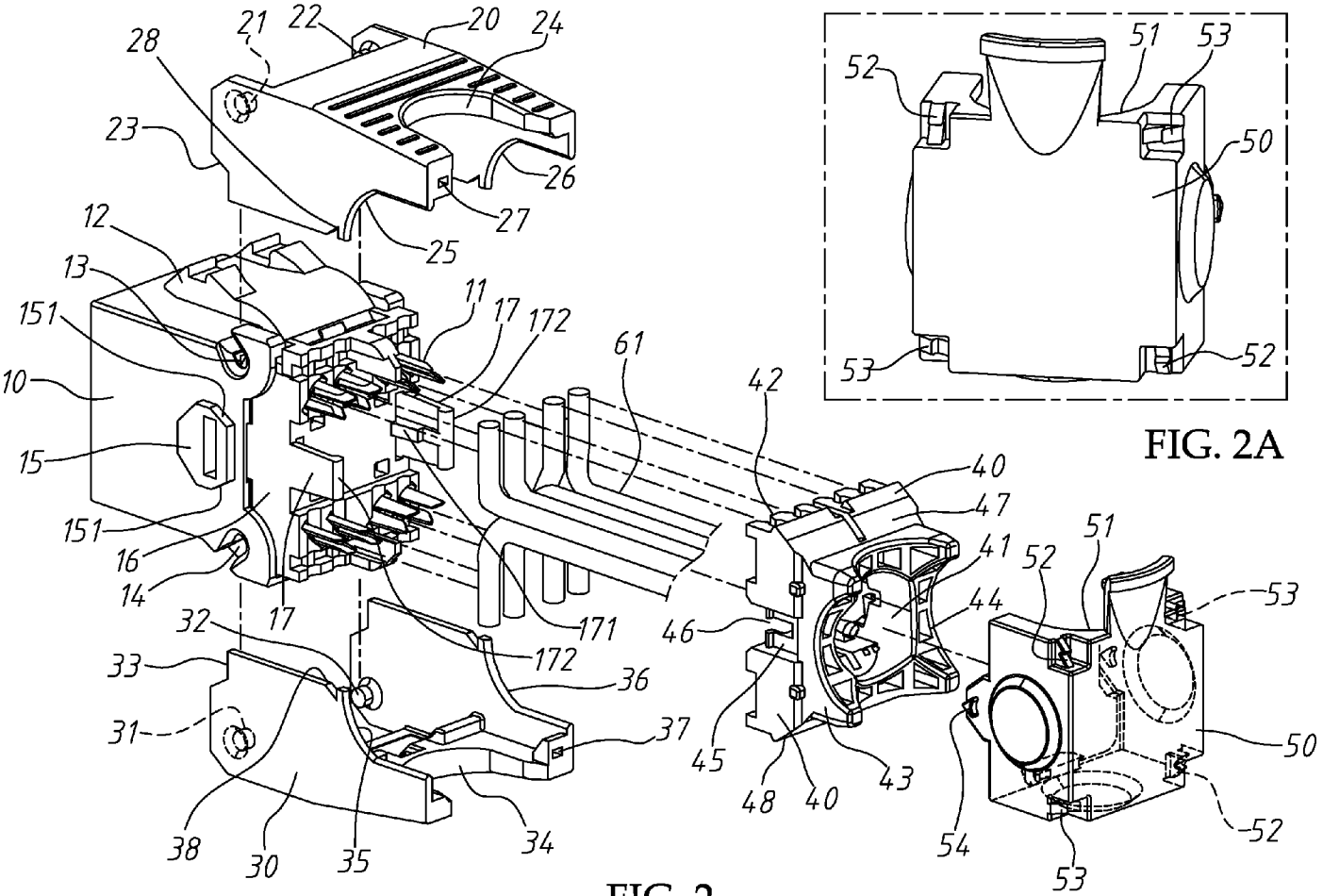
FIG. 2 is an exploded view of the electrical connector in accordance with the present invention with 8 pcs of core wires illustrated.
FIG. 2A is a front view, in an enlarged scale, of the end cap shown in FIG. 2.
Figure 3:
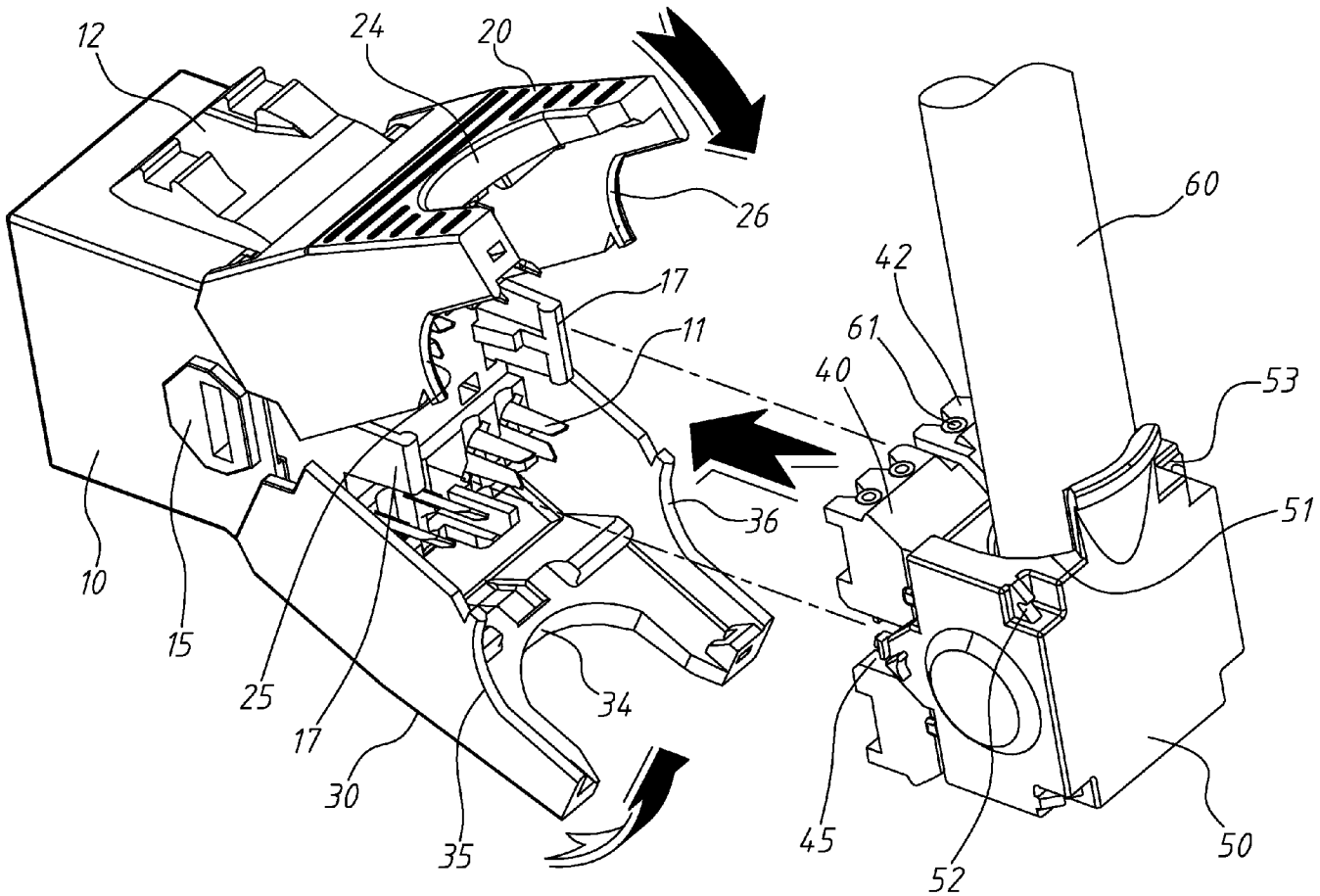
FIG. 3 is a schematic assembly view of the present invention, illustrating the upper and lower cable protector covers opened, the end cap mounted with a cable and connected to the cable organizer.

Referring to FIGS. 1-4, an electrical connector with multi-direction cable installation capability in accordance with a first embodiment of the present invention is shown. As illustrated, the electrical connector comprises a connector body 10. To facilitate understanding the description of the present invention, the left direction of the connector body 10 shown in the drawings is regarded as the front side, and the opposing right direction is regarded as the rear side. Similar to a regular electrical connector, the connector body 10 has a plug hole, (for example, keystone jack) defined in the front side thereof for receiving a mating electrical plug (for example, RJ45 network plug). The electrical connector further comprises an upper cable protector cover 20 and a lower cable protector cover 30 respectively pivotally connected to the connector body 10 at different elevations around the rear side of the connector body 10, a cable organizer 40 mounted in the rear side of the connector body 10 between the upper cable protector cover 20 and the lower cable protector cover 30 for the insertion of a cable and for the positioning of multiple, for example, 8 pcs of core wires 61 of the inserted cable, and an end cap 50 detachably connected to the rear side of the cable organizer 40 opposite to the connector body 10.

The connector body 10 comprises a plurality of insulation displacement contacts (cable insulation piercing contacts) 11 mounted therein and extended out of the rear side thereof for respectively cutting through the insulations of the core wires 61 to make a respective electric contact with the conductor in each respective core wire 61, and a spring hook 12 located at an outer perimeter of the connector body 10 for installation. The connector body 10 further comprises a plurality of pivot holes 13 and 14 respectively disposed in four corners around the rear side thereof. The upper cable protector cover 20 comprises two pivot pins 21 and 22 bilaterally disposed near a front side thereof and respectively pivotally connected to two upper pivot holes 13 of the connector body 10. The lower cable protector cover 30 comprises two pivot pins 31 and 32 bilaterally disposed near a front side thereof and respectively pivotally connected to two lower pivot holes 14 of the connector body 10. Thus, the upper cable protector cover 20 and the lower cable protector cover 30 can be respectively biased relative to the connector body 10 between a close position and an open position. The connector body 10 further comprises two locating blocks 15 bilaterally disposed near the rear side thereof for securing the upper cable protector cover 20 and the lower cable protector cover 30 in place. Each locating block 15 has two bevel guide edges 151 symmetrically disposed at opposing top and bottom sides thereof. Further, the upper cable protector cover 20 comprises two notches 23 respectively disposed corresponding to the top-sided bevel guide edge 151 of each of the two locating blocks 15; the lower cable protector cover 30 comprises two notches 33 respectively disposed corresponding to the bottom-sided bevel guide edge 151 of each of the two locating blocks 15. The connector body 10 further comprises two extension plates 16 inwardly retracted and respectively backwardly extended from two opposite lateral sides thereof, and two pressure bars 17 respectively backwardly extended from the extension plates 16. Each pressure bar 17 has a plug rib 171 located at an inner side thereof, and an end flange 172 located at a distal end thereof.

In this embodiment, the upper cable protector cover 20 and the lower cable protector cover 30 have a substantially U-shaped cross section. The upper cable protector cover 20 and the lower cable protector cover 30 each further comprise a cable insertion opening 24 or 34 defined in an opposing rear side thereof, and two lateral openings 25;26 or 35;36 respectively defined in two opposite lateral sides thereof. When the upper cable protector cover 20 and the lower cable protector cover 30 are closed together, the two lateral openings 25;26 of the upper cable protector cover 20 are respectively abutted to the two lateral openings 35;36 of the lower cable protector cover 30, thereby forming two cable insertion openings. The upper cable protector cover 20 and the lower cable protector cover 30 each further comprise a retaining means, for example, retaining hole 27 or 37 at the rear side thereof for securing the end cap 50, and a bevel guide face 29 or 39 (see FIG. 4) for forcing the core wires 61 against the insulation displacement contact 11.

Figure 4:
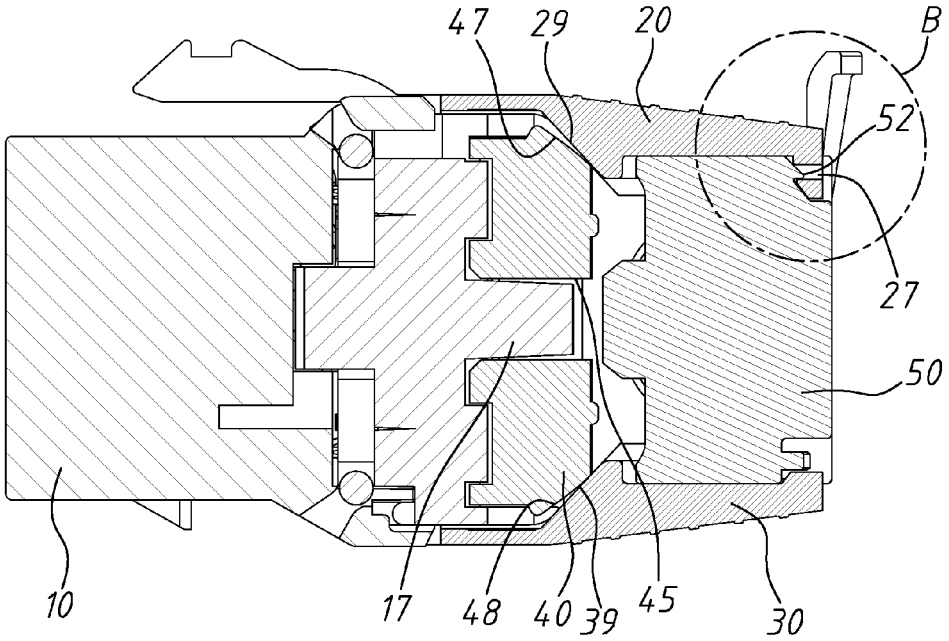
FIG. 4 is a sectional view taken along line A-A of FIG. 1.

The cable organizer 40 comprises a center hole 41 for the insertion of a cable 60 (see FIGS. 2 and 3), a plurality of wire grooves 42 located at a front side thereof and facing toward the connector body 10 for securing the core wires 61 of the inserted cable 60, a protruding seat 43 located at a rear side thereof, a plurality of, for example, four cable grooves 44 formed in the protruding seat 43 at top, bottom, left and right sides, two side notches 45 respectively located at two opposite lateral sides thereof to fit the pressure bars 17 at the extension plates 16 of the connector body 10, two guide slots 46 respectively disposed in the side notches 45 corresponding to the plug ribs 171 of the pressure bars 17, and opposing top and bottom beveled pressure faces 47 and 48 located at the protruding seat 43 corresponding to the bevel guide faces 29 and 39 of the upper and lower cable protector covers 20 and 30 (see FIG. 4).

Figure 4A:
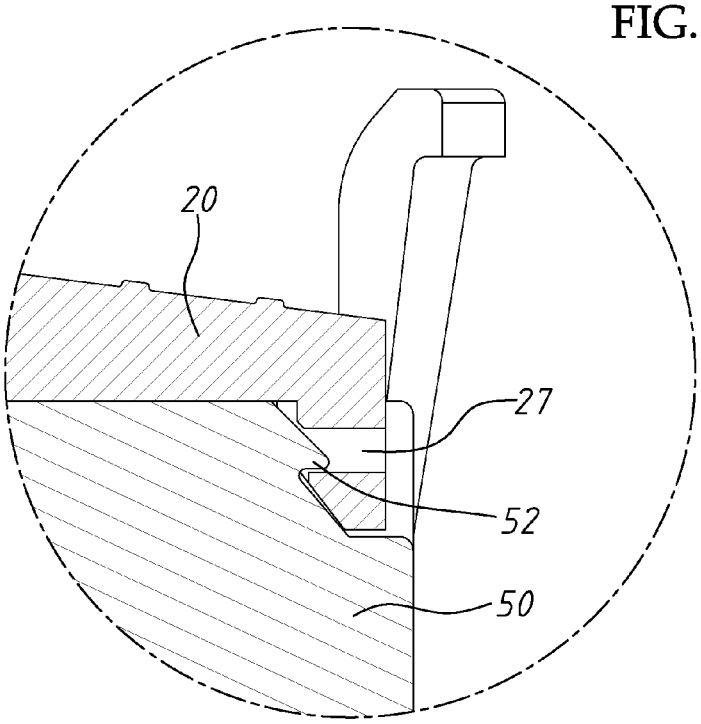
FIG. 4A is an enlarged view of Part B of FIG. 4.

The end cap 50 is attachable to the protruding seat 43 of the cable organizer 40, comprising at least one opening 51 for matching with one cable insertion opening 24 or 34, or lateral opening 25, 26, 35 or 36 of each of the upper and lower cable protector covers 20 and 30 to form a cable passage for the passing of a cable 60, enabling the other cable insertion openings and lateral openings to be blocked. In this embodiment, the cable passage thus formed is disposed at a top side relative to the opening 51, and the left side, right side, bottom side and rear side of the end cap 50 are blocked. The end cap 50 further comprises a plurality of hooks 52 and 53 respectively disposed in four corners of the rear side thereof for hooking in the retaining holes 27 and 37 of the upper and lower cable protector covers 20 and 30. In order to fit the retaining holes 27 and 37 of the upper and lower cable protector covers 20 and 30, two diagonally disposed hooks 52 extend in vertical, and the other two diagonally disposed hooks 53 extend in horizontal. Thus, attaching the end cap 50 to the upper and lower cable protector covers 20 and 30, the hooks 52 and 53 can be respectively and accurately hooked in the retaining holes 27 and 37 (see FIG. 4 and FIG. 4A). In this embodiment, the end cap 50 further comprises a plurality of retaining blocks 54 bilaterally disposed at the front side thereof for engagement with respective bottom retaining grooves 28 at the upper cable protector cover 20 and respective bottom retaining grooves 38 at the lower cable protector cover 30.

Figure 5:
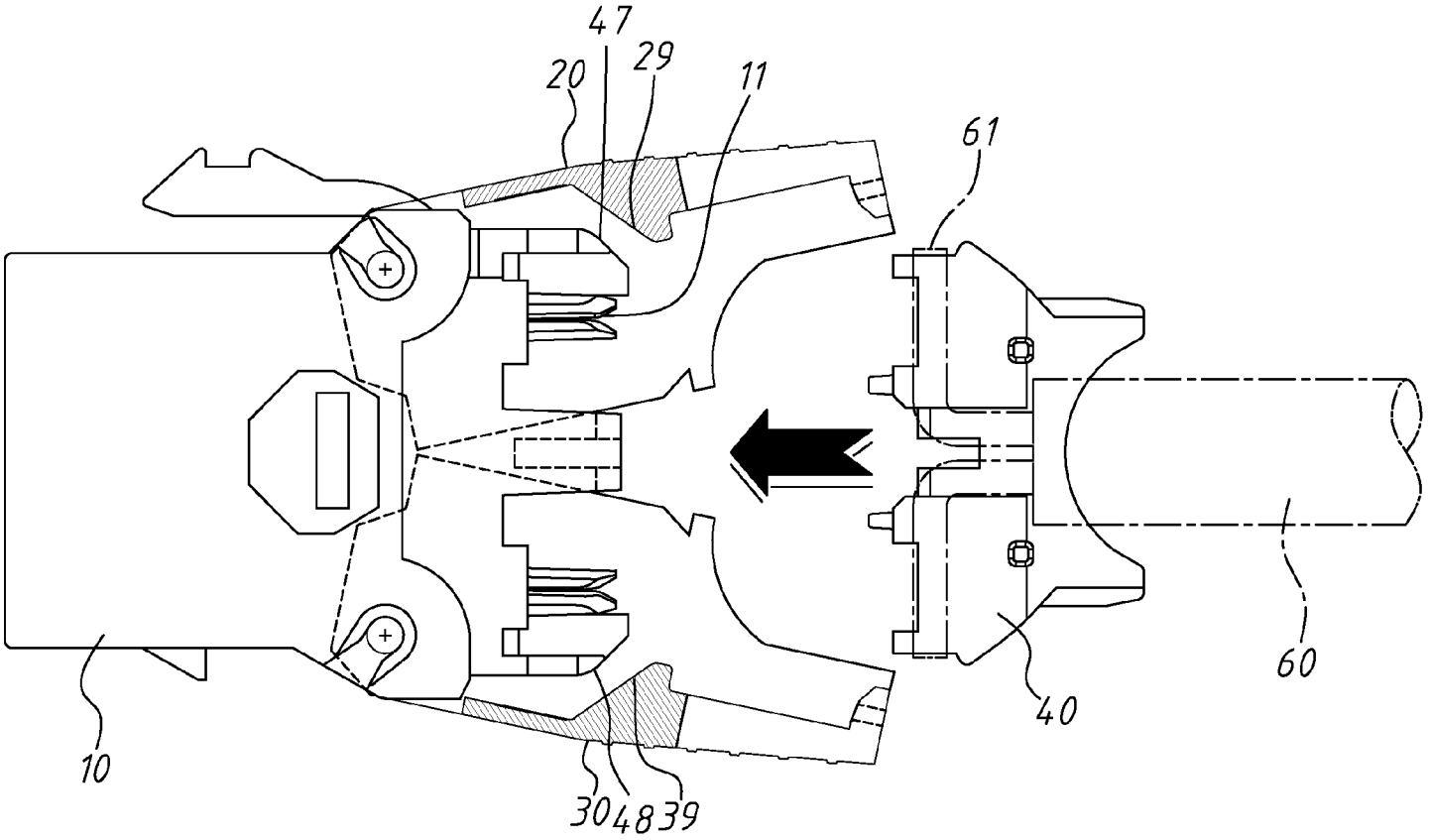
FIG. 5 is an installed view of the present invention, illustrating the core wires of the inserted cable positioned in the cable organizer before insertion of the cable organizer into the connector body.
Figure 6:
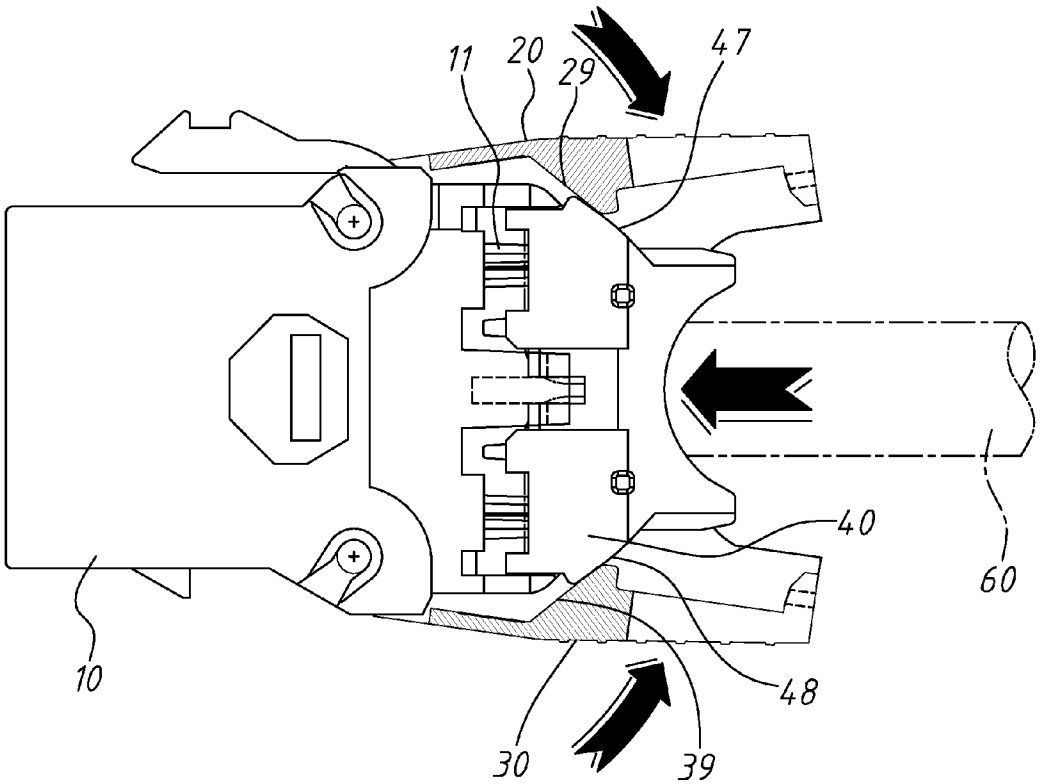
FIG. 6 corresponds to FIG. 5, illustrating the cable organizer inserted into the connector body and the upper and lower cable protector covers respectively forced against the cable organizer.
Figure 7:
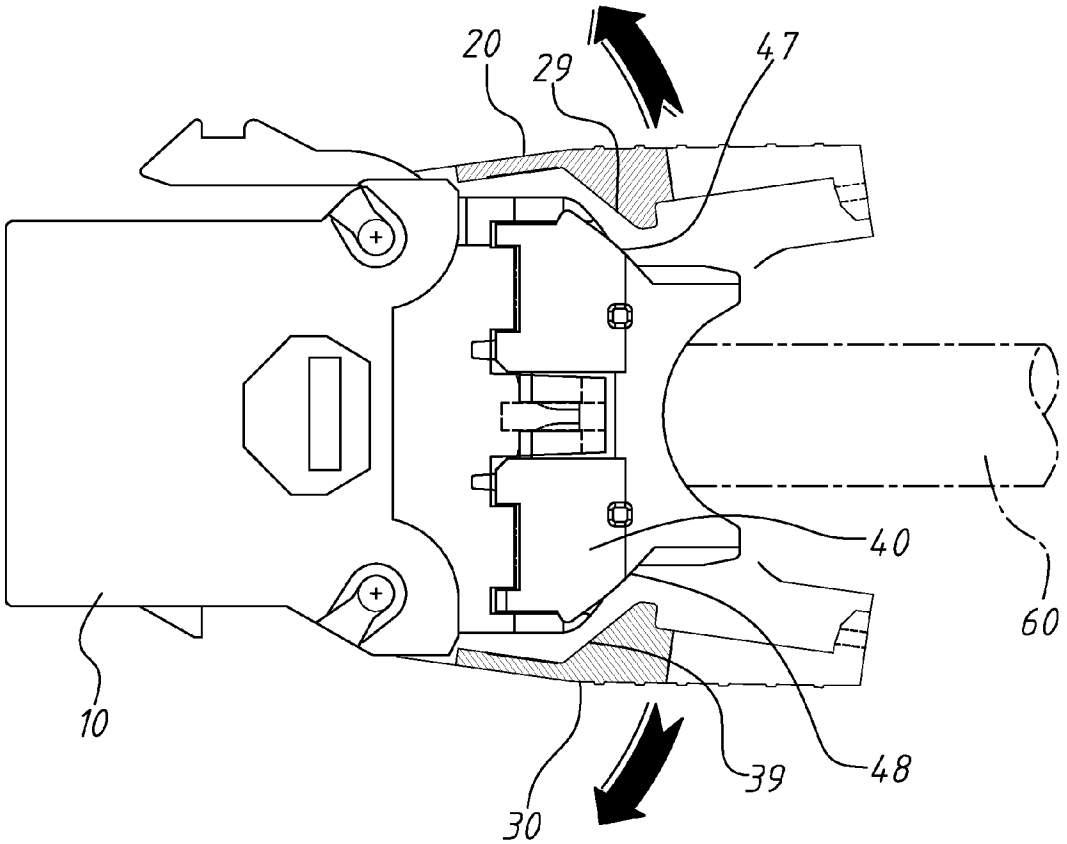
FIG. 7 corresponds to FIG. 6, illustrating the upper and lower cable protector covers opened after connection between the respective insulation displacement contacts and the respective core wires of the cable.
Figure 8:
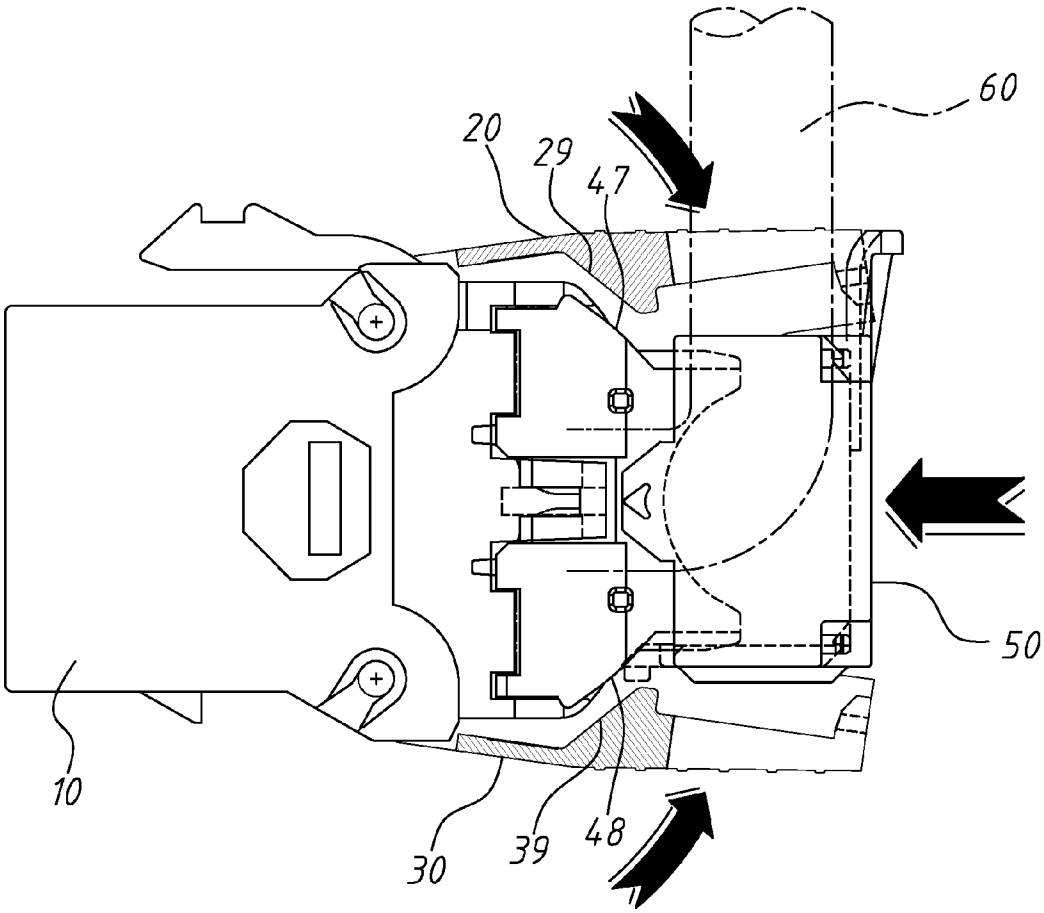
FIG. 8 corresponds to FIG. 7, illustrating the end cap attached to the cable organizer.
Figure 9:
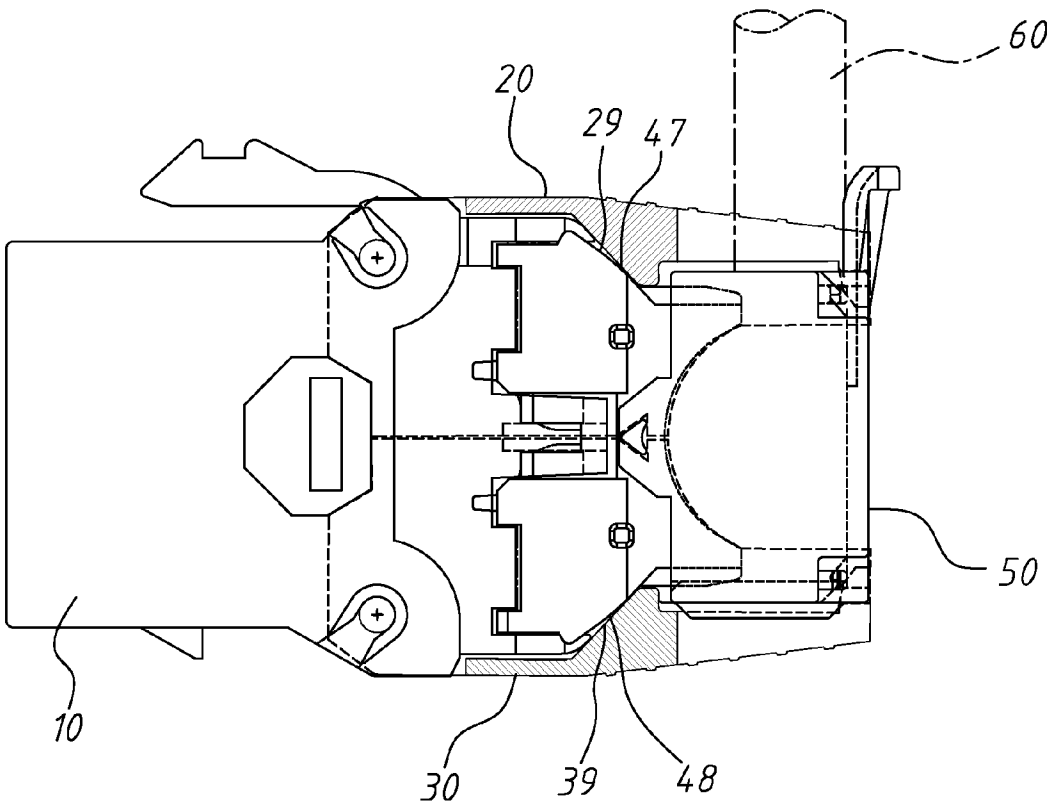
FIG. 9 corresponds to FIG. 8, illustrating the upper and lower cable protective covers locked to the end cap.
Figure 10:
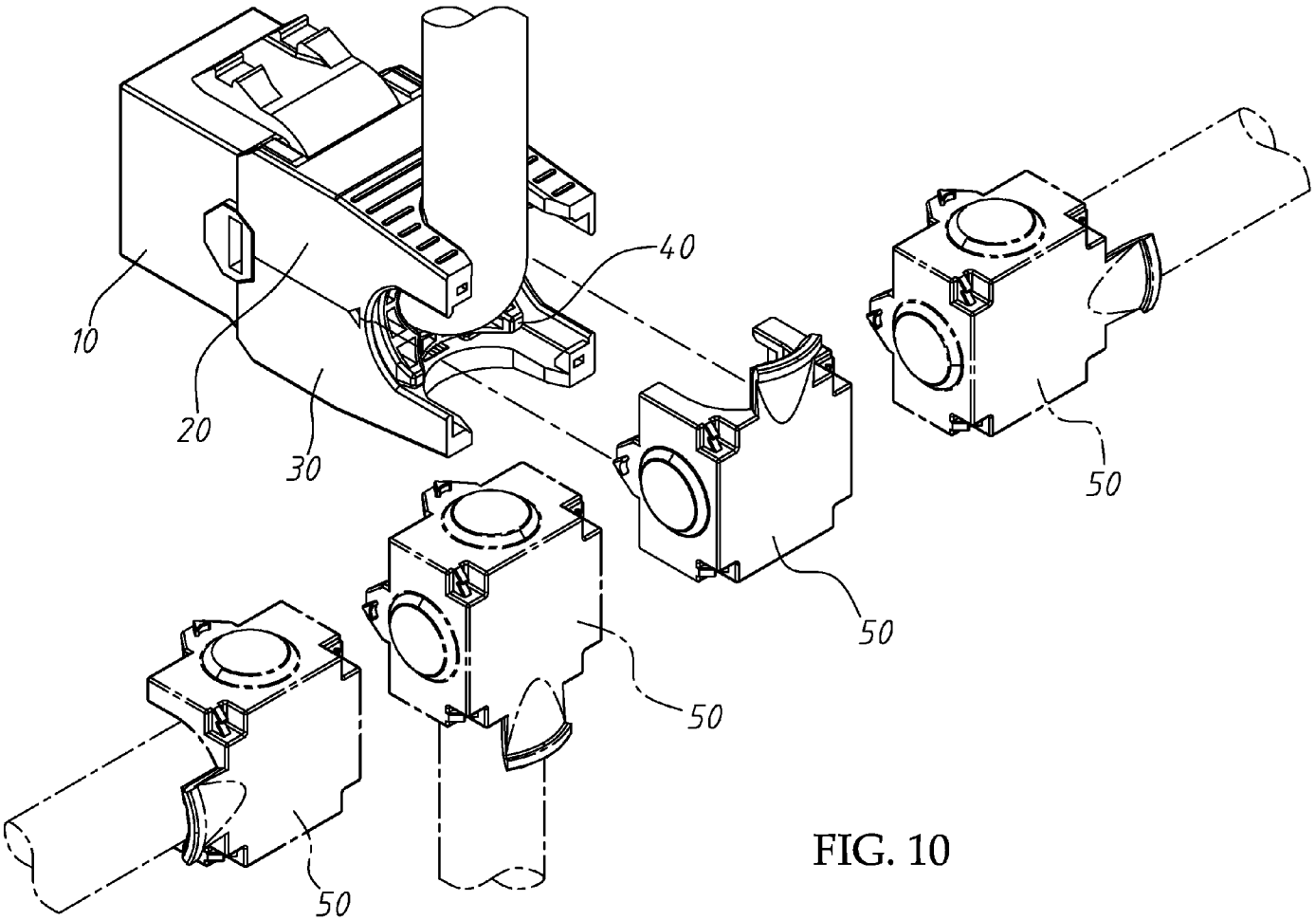
FIG. 10 is a schematic drawing, illustrating a series of selective cable installation directions of the electrical cable in accordance with the present invention.

Referring to FIG. 5, when connecting the electrical connector of the present invention to a cable 60, insert the cable 60 through the center hole 41 of the cable organizer 40 to have the core wires 61 be respectively positioned in the wire grooves 42 of the cable organizer 40, and then push the cable organizer 40 with the inserted cable 60 toward the connector body 10 between the upper cable protector cover 20 and the lower cable protector cover 30 to the limit, and then close the upper cable protector cover 20 and the lower cable protector cover 30 in the directions of the arrowhead indicated in FIG. 6, to abut the respective bevel guide faces 29 and 39 against the respective beveled pressure faces 47 and 48 and to further squeeze the cable organizer 40 toward the inside of the connector body 10 along the horizontal arrowhead indicated in FIG. 6, thereby causing the respective insulation displacement contacts 11 to cut into the respective core wires 61. At this time, the connector body 10 and the cable organizer 40 are secured together, as shown in FIG. 7. Thereafter, open the upper cable protector cover 20 and the lower cable protector cover 30. At this time, as illustrated in FIG. 8, the cable 60 can be extended out of the end cap 50 through a cable passage that is formed of one opening 51 of the end cap 50 and one cable insertion opening 24 or 34, or lateral opening 25/26 or 35/36 of the upper or lower cable protector cover 20 or 30. Thereafter, force the end cap 50 into the protruding seat 43 of the cable organizer 40 to block the other openings, and then close the upper cable protector cover 20 and the lower cable protector cover 30 again, as shown in FIG. 9, to have the hooks 52 and 53 of the end cap 50 be engaged into the respective retaining holes 27 and 37 of the upper and lower cable protector covers 20 and 30, and thus, the installation of the electrical connector is done. According to the present invention, the cable 6 can be selectively extended out of the end cap 50 in one of top, bottom, left and right directions, as shown in FIG. 10.

Figure 11A:
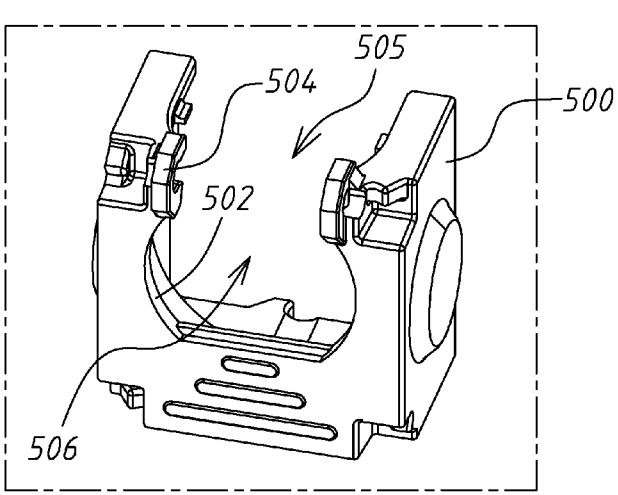
FIG. 11A is a front view, in an enlarged scale, of the end cap shown in FIG. 11.
Figure 11:
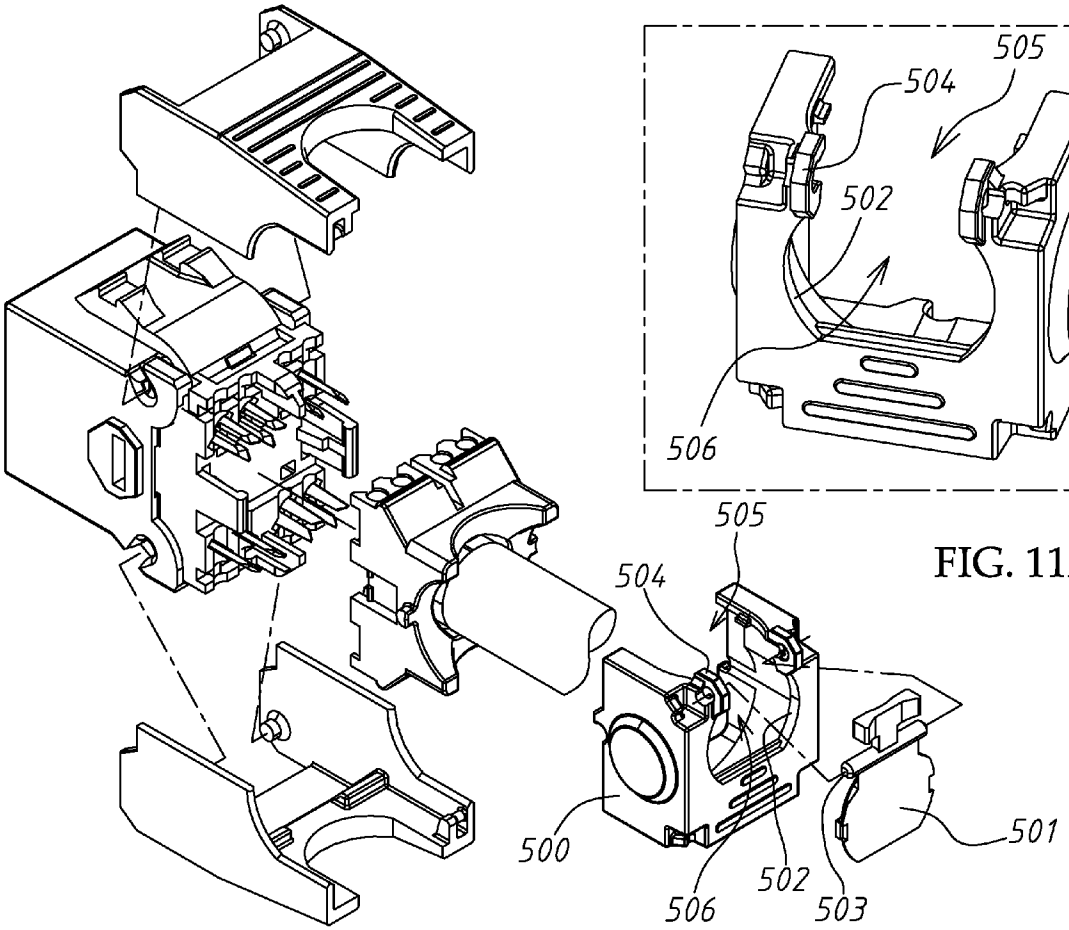
FIG. 11 is an exploded view of an alternate form of the electrical connector in accordance with the present invention.
Figure 12:
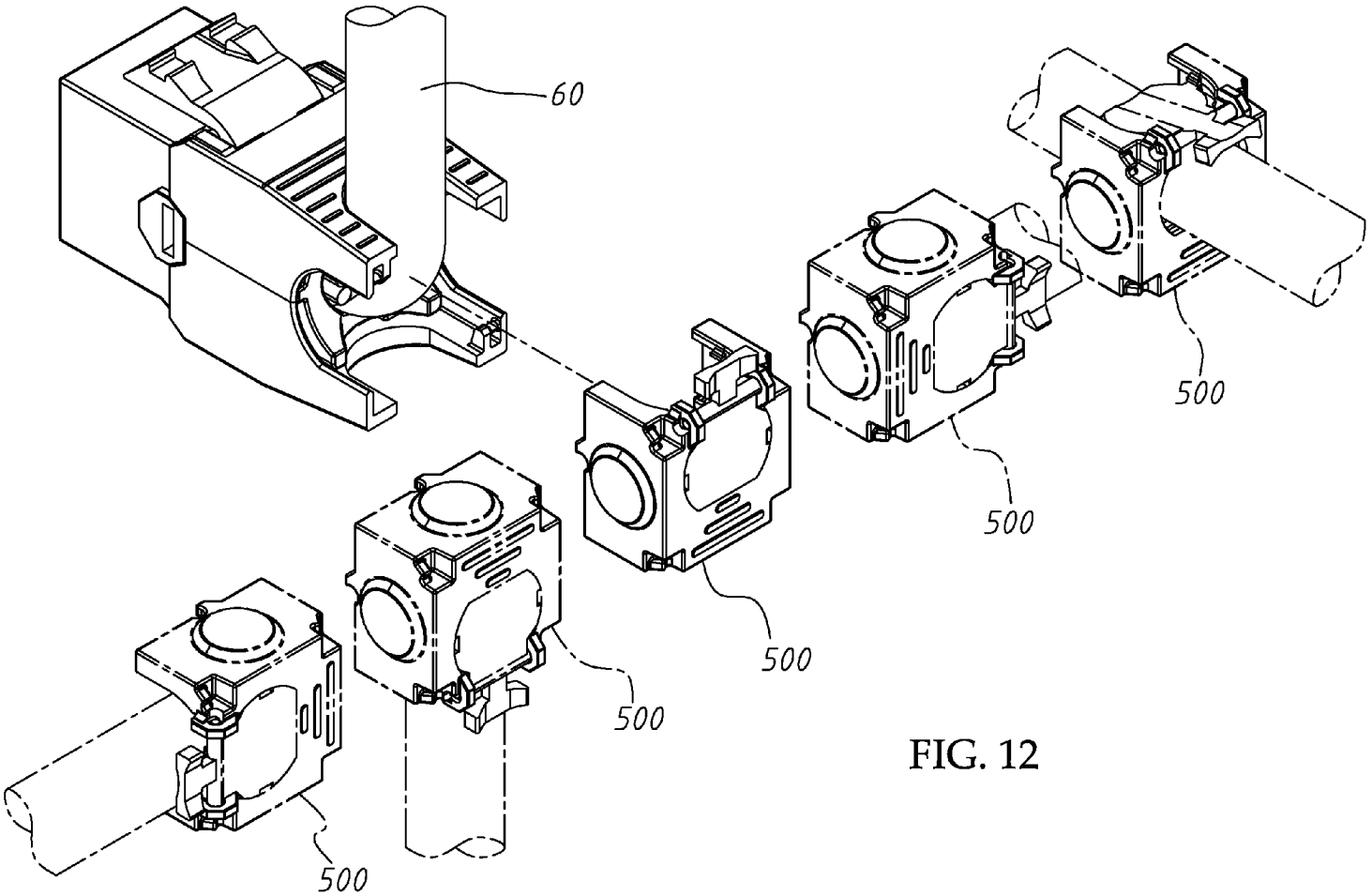
FIG. 12 illustrates a series of selective cable installation directions of the alternate form of electrical cable shown in FIG. 11.

Referring to FIGS. 11 and 11A, an alternate form of the electrical connector of the present invention is shown. This alternate form is substantially similar to the electrical connector shown in FIGS. 1-10 with the exception of the end cap. According to this embodiment, the end cap, referenced by 500, comprises a back opening 502 in a back side thereof for serving as a cable passage, and a movable back cover plate 501 for closing the back opening 502. Preferably, the movable back cover plate 501 has a pivot pin 503 transversely disposed near a top side thereof and pivotally coupled to two pivot holes 504 at two opposite lateral sides of the end cap 500 above the back opening 502. Thus, the movable back cover plate 501 can be biased relative to the end cap 500 between a close position to close the back opening 502 and an open position to open the back opening 502. Actually, in this alternate form, the end cap 500 comprises a first broken hole 505 located in atop side thereof, and a second broken hole 506 defining the back opening 502 and disposed in the communication with the first broken hole 505. The movable back cover plate 501 can be biased relative to the end cap 500 to selectively close the first broken hole 505 or second broken hole 506. Thus, the user can selectively mounted a cable 60 in the electrical connector in one of top, bottom, left, right and rear directions.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

a connector body comprising opposing front and rear sides, a plug hole defined in the front side thereof for receiving an external mating electrical connector, and a plurality of insulation displacement contacts mounted in the rear side thereof;

an upper cable protector cover and a lower cable protector cover respectively pivotally connected to said connector body and biasable relative to said connector body between an open position and a close position, said upper cable protector cover and said lower cable protector cover defining a cable insertion opening in each of top, bottom, left and right sides thereof around the rear side of said connector body when in the close position; and an end cap detachably fastenable to said upper cable protector cover and said lower cable protector cover, said end cap comprising at least one opening selectively forming with one of the cable insertion openings defined by said upper cable protector cover and said lower cable protector cover a cable passage for the passing of a cable that is electrically connected to said insulation displacement contacts.

2. The electrical connector as claimed in claim 1, further comprising:

two extension plates inwardly retracted and respectively backwardly extended from two opposite lateral sides of said connector body;

two pressure bars respectively backwardly extended from said extension plates, each said pressure bar comprising a plug rib located at an inner side thereof and an end flange located at a distal end thereof;

a cable organizer mounted at the rear side of said connector body, said cable organizer comprising a center hole for the insertion of a cable, a plurality of wire grooves located at a front side thereof and facing toward said connector body for securing core wires of an inserted cable, a protruding seat located at a rear side thereof, a plurality of cable grooves formed in said protruding seat at top, bottom, left and right sides, two side notches respectively located at two opposite lateral sides thereof to fit said pressure bars, and two guide slots respectively disposed in said side notches corresponding to said plug ribs of said pressure bars.

3. The electrical connector as claimed in claim 1, wherein said connector body comprises a plurality of pivot holes respectively disposed in corners around the rear side thereof; said upper cable protector cover and said lower cable protector cover each comprise two pivot pins bilaterally disposed at a front side thereof and respectively pivotally coupled to the pivot holes of said connector body.

4. The electrical connector as claimed in claim 1, wherein said upper cable protector cover and said lower cable protector cover each comprise a plurality of retaining holes; said end cap comprises two diagonal pairs of hooks respectively disposed in four corners at a rear side thereof and selectively engaged into said retaining holes of said upper cable protector cover and said lower cable protector cover.

5. The electrical connector as claimed in claim 4, wherein one diagonal pair of hooks of said end cap extends in vertical, and the other diagonal pair of hooks of said end cap extends in horizontal.

6. The electrical connector as claimed in claim 1, wherein said connector body further comprises two locating blocks bilaterally disposed near the rear side thereof for securing said upper cable protector cover and said lower cable protector cover in place, each said locating block having two bevel guide edges symmetrically disposed at opposing top and bottom sides thereof; said upper cable protector cover and said lower cable protector cover each comprise two notches respectively disposed corresponding to said bevel guide edges of said two locating blocks.

7. The electrical connector as claimed in claim 1, wherein said end cap further comprises a plurality of retaining blocks bilaterally disposed at a front side thereof; said upper cable protector cover and said lower cable protector cover each comprise a plurality of bottom retaining grooves respectively forced into engagement with the retaining blocks of said end cap.

8. The electrical connector as claimed in claim 1, wherein said end cap further comprises a back opening serving as a cable passage, and a movable back cover plate adapted for closing said back opening.

9. The electrical connector as claimed in claim 8, wherein said end cap further two pivot holes respectively disposed at two opposite lateral sides thereof above said back opening; said movable back cover plate comprises a pivot pin transversely disposed near a top side thereof and pivotally coupled to the pivot holes of said end cap and biasable relative to said end cap to close or open said back opening.

10. An electrical connector, comprising:

a connector body comprising opposing front and rear sides, a plug hole defined in the front side thereof for receiving an external mating electrical connector, and a plurality of insulation displacement contacts mounted in the rear side thereof;

an upper cable protector cover and a lower cable protector cover respectively pivotally connected to said connector body and biasable relative to said connector body between an open position and a close position, said upper cable protector cover and said lower cable protector cover defining a cable insertion opening in each of top, bottom, left and right sides thereof around the rear side of said connector body when in the close position; and an end cap detachably fastenable to said upper cable protector cover and said lower cable protector cover, said end cap comprising a first broken hole located in a top side thereof, a second broken hole located in a rear side thereof in communication with said first broken hole, and a back cover plate pivotally connected thereto and selectively closing one of said first broken hole and said second broken hole, said first broken hole and said second broken hole being selectively matched with one said cable insertion opening to form a cable passage for the passing of a cable.

* * * * *